US005620220A

United States Patent [19]

Khoshnood

[11] Patent Number: 5,620,220

[45] Date of Patent: Apr. 15, 1997

[54] SANITARY WASTE COLLECTOR

[76] Inventor: Bahram Khoshnood, 1420 NW. Boca Raton Blvd., Boca Raton, Fla. 33486

[21] Appl. No.: 501,280

[22] Filed: Jul. 17, 1995

[51] Int. Cl.[6] ..... A01K 29/00; E01H 1/12

[52] U.S. Cl. ..... 294/1.3

[58] Field of Search ..... 294/1.3–1.5, 8.5, 294/11, 16, 25, 28, 31.1, 55, 99.2, 115, 116; 15/104.8, 257.1, 257.4, 257.6, 257.9; 119/161

[56] References Cited

U.S. PATENT DOCUMENTS

| | | | |
|---|---|---|---|
| 3,767,247 | 10/1973 | Wetzler | 294/1.3 |
| 4,247,139 | 1/1981 | Grieb | 294/1.4 |
| 5,385,376 | 1/1995 | Malaspina | 294/1.3 |
| 5,476,296 | 12/1995 | Gross | 294/1.3 |

FOREIGN PATENT DOCUMENTS

| | | | |
|---|---|---|---|
| 1001377 | 10/1989 | Belgium | 294/1.3 |
| 584040 | 2/1994 | European Pat. Off. | 294/1.3 |
| 4008295 | 10/1991 | Germany | 294/1.3 |
| 4024641 | 2/1992 | Germany | 294/1.3 |
| 8802356 | 4/1990 | Netherlands | 294/1.3 |

*Primary Examiner*—Johnny D. Cherry
*Attorney, Agent, or Firm*—M. K. Silverman

[57] ABSTRACT

A sanitary waste collector includes two substantially planar braces, each having an interior and exterior face, each having a grippable opening, and each pivotally attached to a hinge and an assembly for continuously urging the interior faces of the braces towards each other, and an assembly for selectably manually actuatably urging the braces away from each other, in which a selectably imparted force of the manually actuable is sufficient to overcome the force of the assembly urging the braces towards each other. Two arms, each individually extending integrally outwardly from the braces' edges thereof opposite the hinge, provide a platform for a deformable enclosure secured between the arms. The interiorly urging assembly is normally closed when the selectable manual actuation assembly is not actuated. Upon gripping closure of the selectable manual actuation assembly, the enclosure is opened, and can be placed over and around pet waste or other materials to be disposed of. Upon release of the actuation assembly, the enclosure assembly is returned to its normally closed position, completely encasing and containing the pet waste.

13 Claims, 7 Drawing Sheets

SANITARY WASTE COLLECTOR

BACKGROUND OF THE INVENTION

This invention relates to a sanitary waste collector for picking-up pet waste and other material that should not be touched by hand. Various sanitary waste collectors for holding pet waste have been proposed. Although these devices have sometimes involved mechanical tools which are positioned over the waste and are then manipulated to close the arms or similar elements to contain the waste, these devices have suffered from several disadvantages.

For example, these prior art devices have not effectively provided a disposable receptacle or container for such waste. Moreover, some of the prior art devices have also had the further disadvantage of getting soiled, after the device has been put to repeated use. Certain of these prior art devices have attempted to overcome these problems and disadvantages through the use of bags and other containers attached to the arms of the device. These devices, however, have been less than satisfactory.

The prior art, as is known to the inventor, is reflected in U.S. Pat. No. 4,247,139 to Greib, which teaches a Sanitary Waste Collector. However, Greib teaches a fixed frame sanitary waste collector, which uses an open container at its lower extremity, which is then closed and sealed around the pet waste. The containers are always in an open position until use. Furthermore, the bendable lip on the outside edges of the container does not allow the edge of the container to effectively scoop the feces into it, and therefore will often smear the feces or cause it to be caught between the edges of the container, thus preventing sanitary closure of the container.

The instant invention is composed mainly of two moving braces which are held in a closed position until force is exerted upon the handle, whereby the braces open outwardly to provide a sanitary enclosure. The arms upon which the sanitary enclosure rests are thin enough to allow the enclosure to efficiency scoop feces into its enclosure without smearing or catching the waste in the edges, thus providing a truly sanitary closure.

Other devices exist for collecting waste sanitarily, but are considered non-analogous to the present invention. Neither these nor other references known to the inventor address or solve the problem solved by the instant invention, that is, a truly sanitary waste collector which keeps the sanitary enclosure positively closed until pressure is exerted on the handle.

SUMMARY OF THE INVENTION

The present invention relates to a sanitary waste collector for picking-up and enclosing pet waste or other materials. The collector comprises two substantially planar braces, attached to a hinge means, each having a common grippable opening. Further included are means for continuously urging the braces towards each other, means for selectably manually actuatably urging the braces away from each other, where the selectably imparted force of the manually actuable means is sufficient to counteract the force of the means continuously urging the braces towards each other. Two arms integrally extend outwardly from each of said braces in which the edges thereof are each opposite from said hinge means. Further provided is deformable enclosure means between the respective arms.

It is an object of the present invention to provide a means for one to collect pet waste, or other materials, from the ground and keep it in a positively locked enclosure, until the user is ready to dispose of the enclosure.

It is another object to provide an economical and sanitary waste container for disposal of collected waste.

It is a yet further object of the present invention to provide a sanitary waste container which is not harmful to the environment upon disposal.

It is a yet further object to provide a sanitary waste collector which can be operated safely, with minimal risk of fingers being caught in the mechanical action of the collector.

The above and yet further objects and advantages of the present invention will become apparent from the hereinafter set forth Brief Description of the Drawings, Detailed Description of the Invention and Claims appended herewith.

BRIEF DESCRIPTION OF THE DRAWINGS

FIGS. 9A and 9B show a second embodiment of the handle and brace opening assembly.

DETAILED DESCRIPTION OF THE INVENTION

Figure 1:
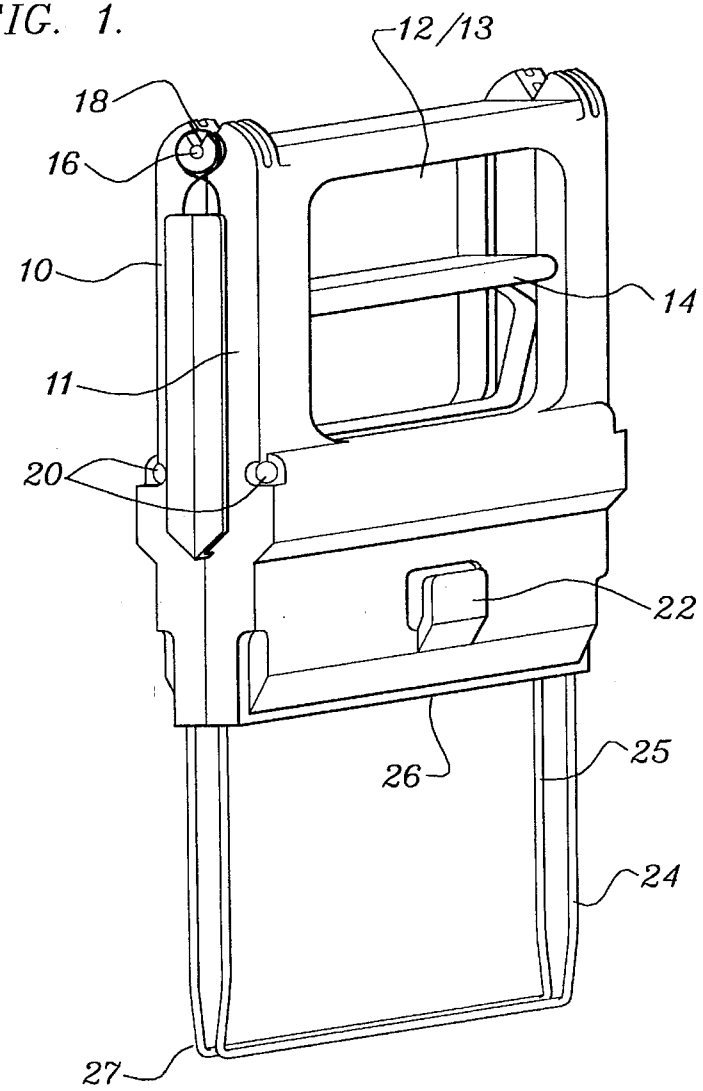
FIG. 1 is a perspective view of the sanitary waste collector.
Figure 3:
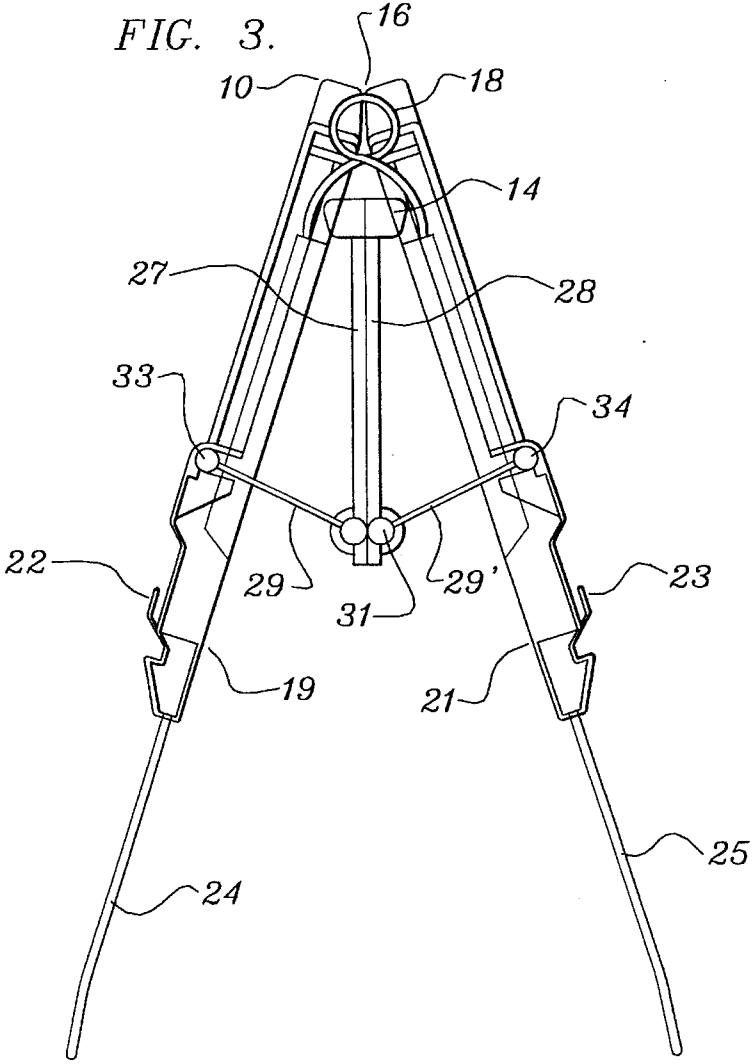
FIG. 3 is a side view of the sanitary waste collector, illustrating the collector in an open position.

The instant invention may be embodied as shown in FIG. 1, the same including two substantially planar braces 10 and 11, each having grippable openings 12 and 13. Said braces are joined at one end by an axial hinge 16. The hinge 16 is defined by two springs 18 which urge the braces 10 and 11 into constant contact with each other's interior faces 19 and 21 (See FIG. 3).

The braces 10 and 11 include hooks 22 and 23 on their exterior faces, to which a deformable sanitary enclosure 30 is attachable.

The braces 10 and 11 also have arms 24 and 25, constructed of a preferably U-shaped rod, connected at both ends thereof to an edge opposite said common hinge 16, and extending outwardly preferably, slightly angled towards each other to touch each other at an outermost common edge 27.

The ratio of the length of the collector, that is, from the outermost edge 27 of the arms 24 and 25 to the common hinge 16, to the width of the braces 10, may be between 1:1 and 4:1, with 2:1 being optimal. The overall length of the collector should be between 1 and 2 feet, with one foot being optimal. It has been found that these parameters provide both technical and ergonomic advantages of operation.

Figure 2:
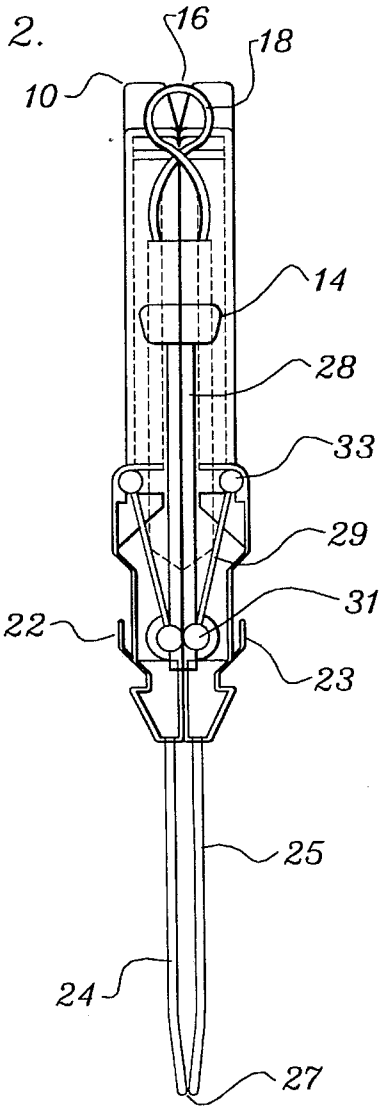
FIG. 2 is a side view of thereof illustrating the collector in a closed position.

A handle assembly includes a handle 14 placed in between the openings 12/13 in the braces 10/11. See FIGS. 1 to 3. The assembly includes two substantially planar bodies 27 and 28, each of which is pivotally attached, at pivot axis 31, to two planar bodies 29 and 29' which are also each pivotally attached at their other ends to respective interior faces 19/21 of the braces 10/11 at pivot axes 33 and 34 within each of the braces. Thus, when pressure is exerted on the handle 14, pulling it up towards the common hinge 16 of the braces 10/11, the planar bodies 27/28 exert adequate force to overcome the force generated by the springs 18 on the ends of the common hinge 16 otherwise urging the braces 10/11 into contact. See FIG. 3.

Figure 4:
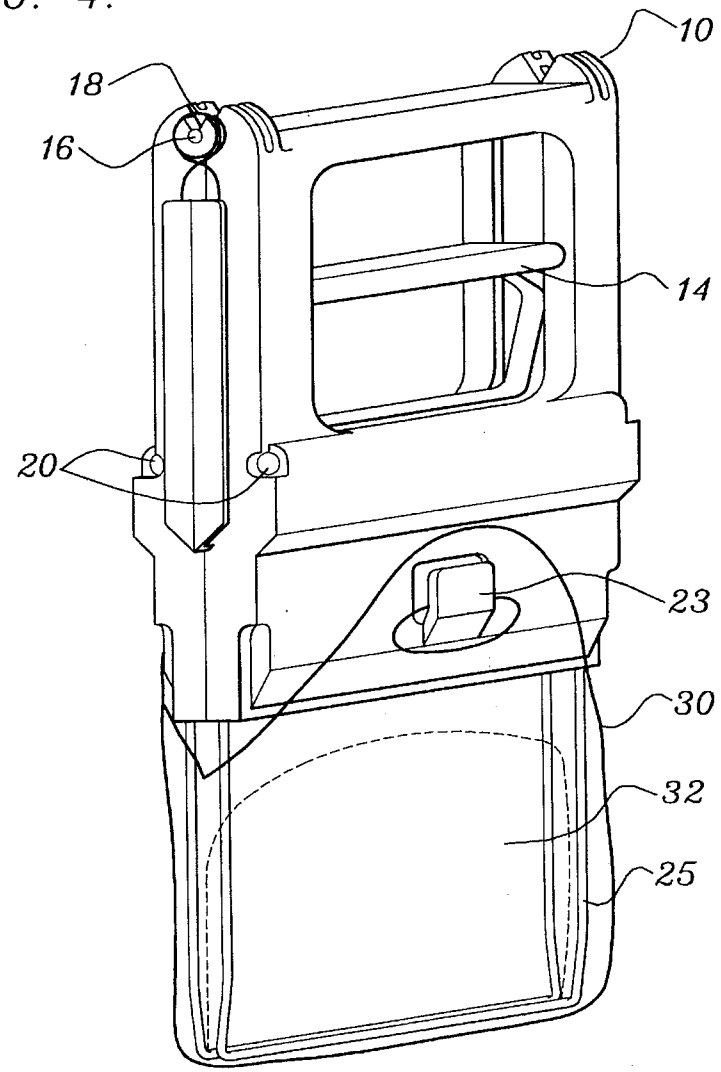
FIG. 4 is a perspective view thereof with an enclosure attached.
Figure 6:
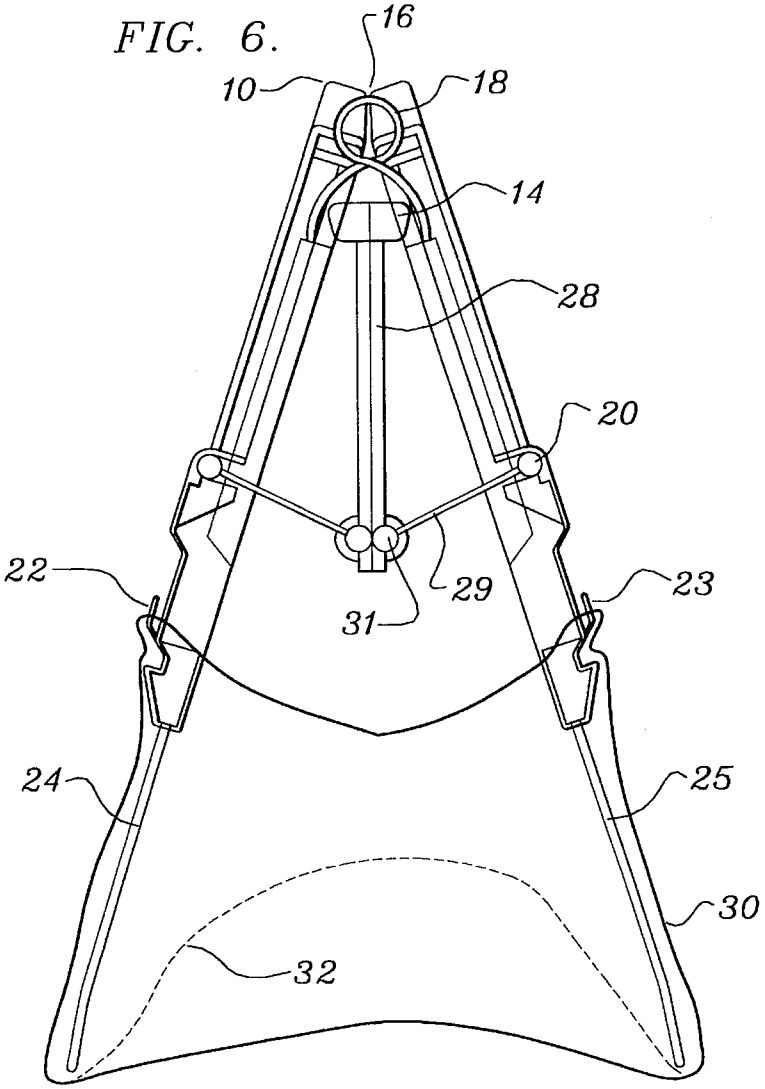
FIG. 6 is a side view thereof of the sanitary waste collector with an enclosure attached, illustrating the Collector and Enclosure in the open position.
Figure 5:
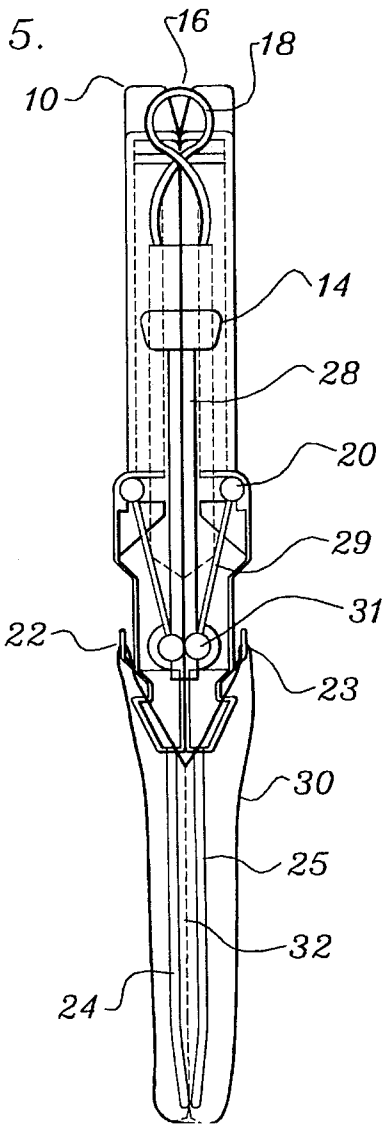
FIG. 5 is a side view of the sanitary waste collector with an enclosure attached, illustrating the collector and enclosure in their closed positions.
Figure 7B:
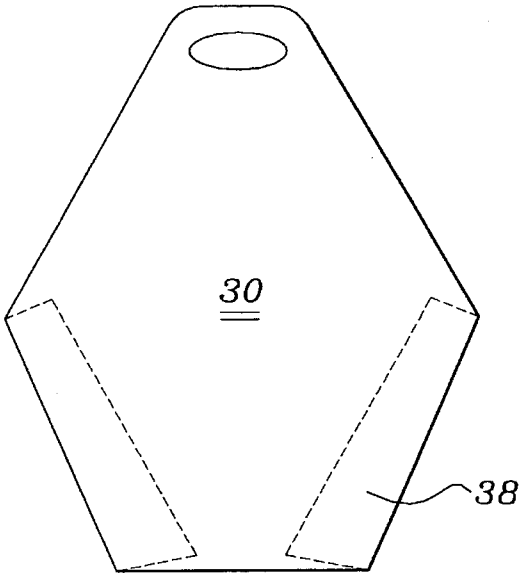
FIGS. 7A to 7C show a disposable enclosure, in from, front internal and perspective views thereof.
Figure 7C:
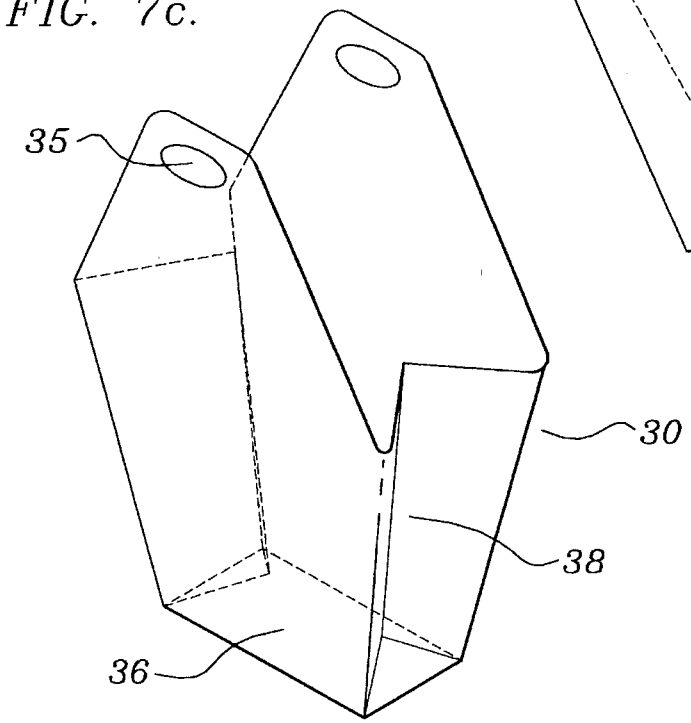
Figure 7A:
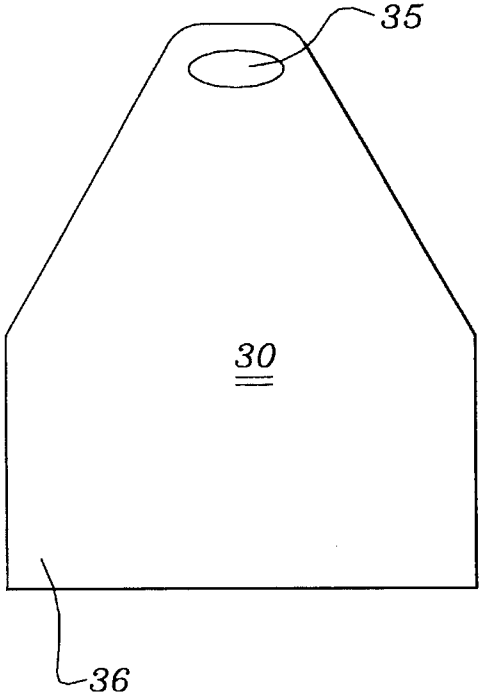
Figure 8C:
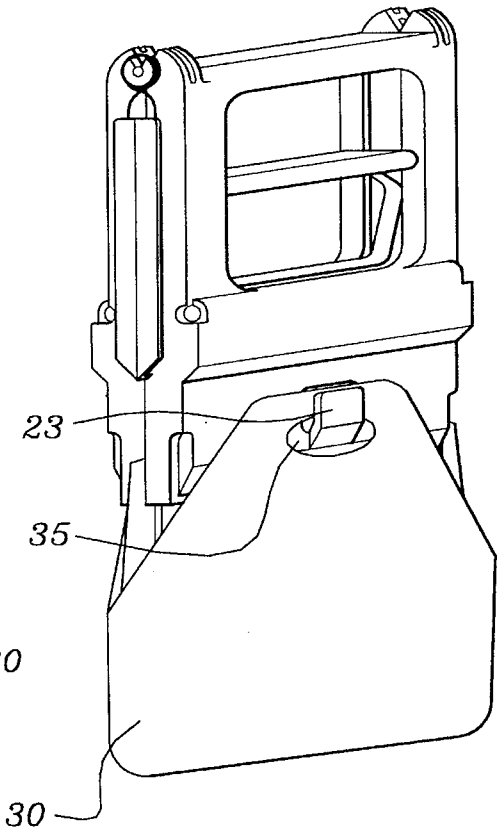
FIGS. 8A to 8C show the sequence of attachment of the enclosure.
Figure 8B:
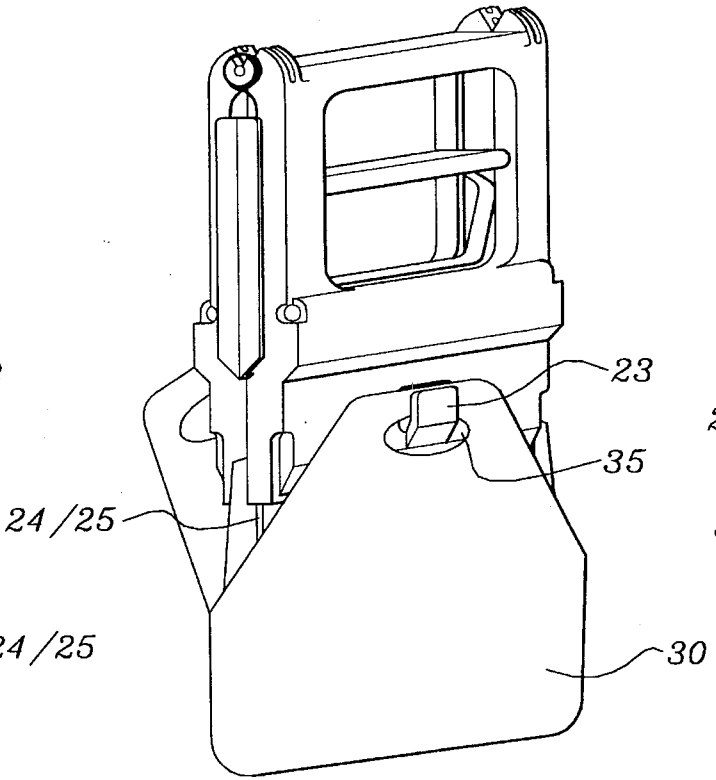
Figure 8A:
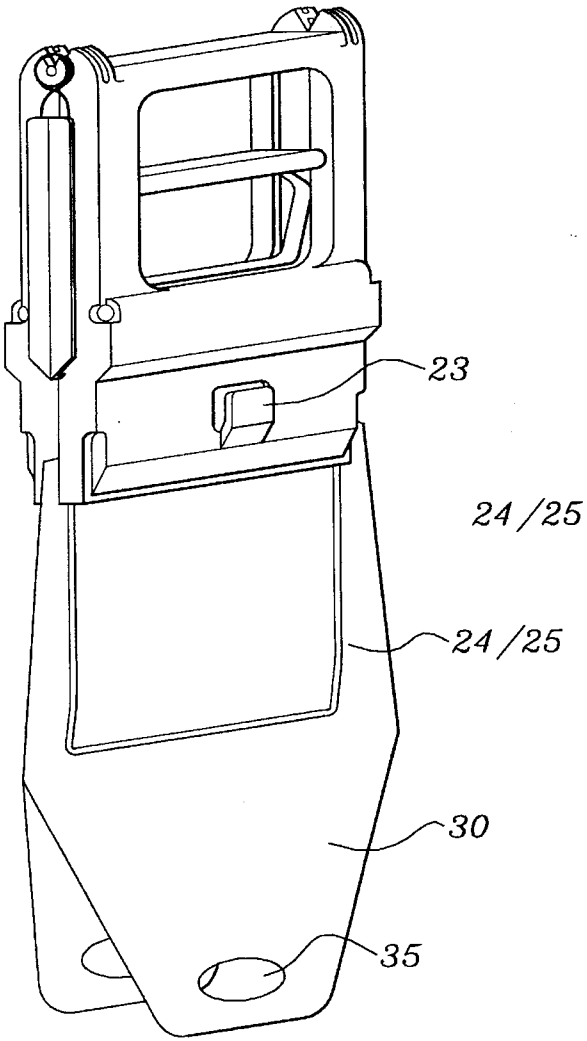

FIGS. 4 to 6 illustrate enclosure 30, which is preferably deformable and biodegradable, which serves as a sanitary enclosure securable to the arms 24/25 of the collector. FIGS. 7A to 7C illustrate the enclosure 30 including its upper ends 35 and lower end 36. In FIGS. 7B and 7C may be seen interior folds 38 of enclosure 30. The enclosure 30 at upper ends 35 attach to said hooks 22/23 (see FIG. 5–6). on the braces 10/11. The bag's lower end 36 is inverted and folded between the arms 24/25 to form an envelope 32. More particularly, the sequence of steps associated with securement of the enclosure 30 to the arms 24/25 and hooks 22/23 is shown in FIGS. 8A to 8C.

The envelope 32 is closed when the braces 10/11 are closed, in response to an absence of pressure on the handle 14, as illustrated in FIG. 5. The envelope 32 is opened upon application of pressure on handle 14 to thereby open the braces 10/11, as illustrated in FIG. 6. Thus, the enclosure can be placed over the material to be disposed of. Once pressure is released from the handle 14, and the braces 10/11 close as the urging force of the springs 18 is no longer countered by force exerted on the handle 14, the envelope 32 encloses the materials to be collected, with the arms 24/25 keeping the waste secure. The enclosure 30 can then be unhooked from the hooks 22/23 and pulled downward to completely encase the waste. The braces 10/11 can then be reopened and the bag enclosure 30 extracted with the waste inside it for sanitary disposal.

Figure 7E:
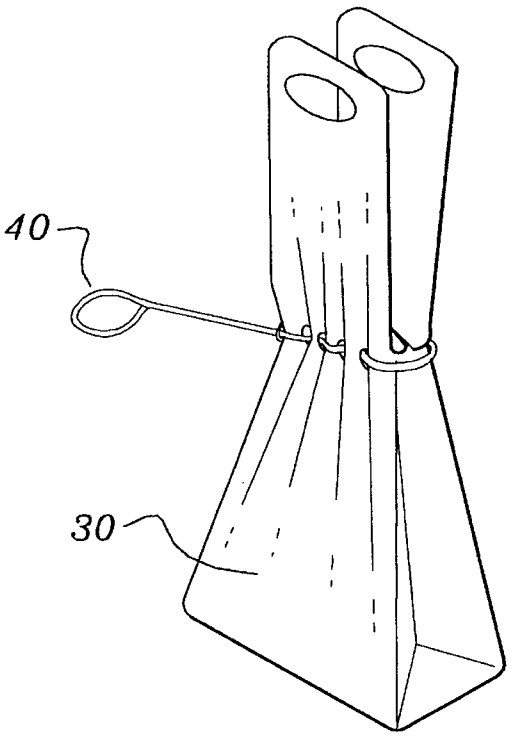
FIGS. 7D and 7E are views of a sealable enclosure usable with the present invention.
Figure 7D:
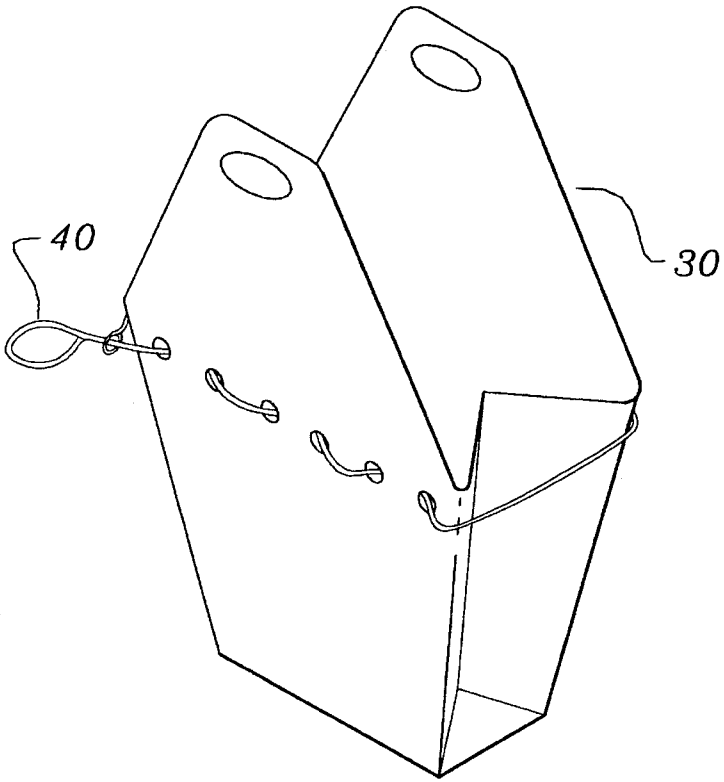

In FIGS. 7D and 7E is shown the manner in which a pull-string 40 may be incorporated into enclosure 30 to facilitate the positive closure thereof.

In FIGS. 9A and 9B is shown a further embodiment of the invention in which a wedge 42 is used in lieu of planar bodies 29 and 29' to effect the opening of braces 10 and 11.

While there has been shown and described the preferred embodiment of the instant invention, it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

Having thus described my invention what I claim as new, useful, and non-obvious and, accordingly, secure by Letters Patent of the United States is:

1. A sanitary waste collector, comprising:

(a) two substantially planar braces, each having an interior and exterior face, each having a common grippable opening, and each pivotally attached, at one transverse edge thereof, to a hinge means, each of said braces also defining opposite transverse edges thereof;

(b) means for continuously urging said interior faces of said braces toward each other;

(c) means for selectably manually actuatably urging said braces away from each other, in which an impartable force thereof is sufficient to overcome an imparted force of said continuously urging means (b) otherwise pressing said braces toward each other;

(d) two arms, each extending integrally outwardly from said opposite transverse edges of each of said braces; and (e) enclosure means selectably securable between said arms, said enclosure means normally closed when said selectably urging means (c) are not actuated, whereby, upon actuation of said selectably urging means (c), said arms and said enclosure means are opened such that, within said enclosure means, can be placed pet waste or other materials to be sanitarily disposed of and, upon release of said selectably urging means (c), said enclosure means are returned to their normally closed position, thereby containing and encasing said waste or other materials.

2. The sanitary waste collector as recited in claim 1, wherein the ratio of the length of the entire collector, from said hinge means to an outermost portion of said arms, relative to the width is in a range of about 1:1 to about 4:1.

3. The sanitary waste collector as recited in claim 1, wherein said substantially planar braces each have an opening in its center, proportioned to allow human digits to pass therethrough freely.

4. The sanitary waste collector as recited in claim 1, wherein said selectable manual actuation means comprise a handle assembly having an upper and lower end.

5. The sanitary waste collector as recited in claim 4, wherein said handle's upper end rests in the opening in said braces.

6. The sanitary waste collector as recited in claim 4, wherein said assembly further comprises two substantially planar bodies, each having inner and outer axes, wherein each of said bodies' inner axes are pivotally attached to said handle assembly's lower end.

7. The sanitary waste collector as recited in claim 6, wherein said planar bodies' outer axes each pivotally attach to opposite interior faces of said braces.

8. The sanitary waste collector as recited in claim 1, wherein said arms are comprised of a U-Shaped rod, ranging from about 0.03 inches to about 0.25 inches in diameter integrally connected to said opposite transverse edges of said braces, and extending outwardly therefrom.

9. The sanitary waste collector as recited in claim 8, in which said arms are directed slightly inwardly toward each other such that outer edges thereof not in communication with said braces are normally in contact with each other.

10. The sanitary waste collector as recited in claim 1, wherein said enclosure means comprises a bag having an upper and lower end, in which said bag 's lower end rests between said arms.

11. The sanitary waste collector as recited in claim 10, wherein said bag comprises a biodegradable material.

12. The sanitary waste collector as recited in claim 10, wherein said bag includes two elements at its upper end each attachable to said braces' exterior faces.

13. The sanitary waste collector as recited in claim 1, wherein said means for continuously urging said braces towards each other comprises spring means, said hinge means and extending to each of said braces, imparting force to cause said braces to urge them towards each other.

* * * * *